US008529479B2

(12) United States Patent
Kelly

(10) Patent No.: US 8,529,479 B2
(45) Date of Patent: Sep. 10, 2013

(54) SHOULDER CONTINUOUS PASSIVE MOTION DEVICE

(76) Inventor: Robert A. Kelly, Kennesaw, GA (US)

( * ) Notice: Subject to any disclaimer, the term of this patent is extended or adjusted under 35 U.S.C. 154(b) by 1022 days.

(21) Appl. No.: 12/565,507

(22) Filed: Sep. 23, 2009

(65) Prior Publication Data

US 2010/0076354 A1 Mar. 25, 2010

Related U.S. Application Data

(60) Provisional application No. 61/099,444, filed on Sep. 23, 2008.

(51) Int. Cl.
*A61H 1/02* (2006.01)

(52) U.S. Cl.
USPC ..... 601/5; 601/23; 601/33

(58) Field of Classification Search
USPC ..... 601/5, 23, 24, 26, 33, 40, 84, 97, 601/98, 101
See application file for complete search history.

(56) References Cited

U.S. PATENT DOCUMENTS 4,651,719 A 3/1987 Funk
5,067,479 A * 11/1991 Saringer et al. ..... 601/5
5,179,939 A 1/1993 Donovan
5,417,643 A 5/1995 Taylor
5,665,058 A 9/1997 Young
5,951,499 A 9/1999 Saringer
6,146,341 A 11/2000 Sato
6,676,612 B1 1/2004 Beny
D486,870 S 2/2004 Mason
7,108,664 B2 9/2006 Mason
2004/0153010 A1 8/2004 Bonutti
2007/0225620 A1 9/2007 Cariggnan
2008/0119764 A1 * 5/2008 Song et al. ..... 601/23

OTHER PUBLICATIONS

MTL 2470 Shoulder CPM by McKelor Technoogies, www.mckelor.com/2470_shoulder_cpm.cfm, accessed May 15, 2008.
S3 Choulder CPM by Otto Bock HealthCare, accessed May 15, 2008.

* cited by examiner

*Primary Examiner* — Quang D Thanh
(74) *Attorney, Agent, or Firm* — Ballard Spahr LLP

(57) ABSTRACT

A shoulder continuous passive motion ("CPM") device is provided. The shoulder CPM has a motor and a drive mechanism configured to move a slidable arm holder linearly back and forth. The motor can move the drive mechanism linearly back and forth. The drive mechanism can be attached to the arm holder. A user can insert at least a portion of his arm into the arm holder, such that the shoulder CPM device moves his arm linearly back and forth, thereby providing therapeutic treatment to the shoulder of the user.

19 Claims, 5 Drawing Sheets

SHOULDER CONTINUOUS PASSIVE MOTION DEVICE

This application claims priority to and the benefit of U.S. Provisional Application No. 61/099,444, filed on Sep. 23, 2008, which is incorporated in its entirety in this document by reference.

FIELD TO THE INVENTION

The field of this invention relates generally to continuous passive motion ("CPM") devices used for therapeutic treatment of joint injuries, and more particularly to a shoulder CPM device for rehabilitation of a shoulder joint injury.

BACKGROUND OF THE INVENTION

CPM therapy is used to aid in recovery following joint trauma and has been found to have beneficial results in the rehabilitation of injured joints and/or limbs. Passive motion can also be used for treatment of other bone and muscular disorders, such as arthritis.

The shoulder is formed where the clavicle, scapula and humerus join laterally. The joint formed is a ball and-socket type articulation between the proximal humerus and the glenoid cavity of the scapula. The socket is shallow, and the joint capsule is loose-fitting. As a result of this construction, the joint permits a wide range of motion but the joint is subject to poor stability and strength.

The shoulder is capable of three types of motion: abduction and adduction (up and down), simple back and forth (anterior/posterior), and rotation. Abduction and adduction is movement of the arm away from and toward the median axis, or long axis, in the median plane of the body, defined by the front or back of the body in a straight position. Back and forth motion means moving the arm forward and upward or backward and upward to increase the angle between the arm and the median plane of the body. Rotation is turning the arm about its long axis as if on a pivot.

Following shoulder injury, it is desirable to recover range of motion in the shoulder joint. It also would be desirable for a person recovering from a shoulder injury to have access to a CPM device that could be used in any location, such as, for example, a home or office. In view of the preceding, there is a need for a CPM device that can induce motion in a shoulder to aid in recovery and that can be relatively lightweight and/or portable for ease of use in any setting.

SUMMARY

The invention relates to a shoulder continuous passive motion device. In one aspect, the shoulder CPM device can comprise a motor and a drive mechanism configured to move a slidable arm holder back and forth along a substantially linear path. In another aspect, the shoulder CPM device can further comprise a support frame and a base plate. The support frame can be configured such that the other components of the shoulder CPM device can be mounted thereto as desired. Additionally, the support frame can be configured to position the arm holder, and thus the arm of a user, in a proper position for therapeutic treatment. In still another aspect, the support frame can be adjustable so that the device can be used effectively by users of various sizes. The base plate can be a covering to separate the arm holder from the drive mechanism to reduce the chance of injury to a user.

The slidable arm holder can comprise, in one aspect, an arm rest configured for cradling the arm of a user. The arm rest can comprise an elbow pad, a hand grip, and at least one strap. In another aspect, the elbow pad and the hand grip can be mounted interchangeably thereto the arm rest so that the shoulder CPM device can be used effectively by a left arm as well as a right arm. In a further aspect, the elbow pad and/or the hand grip can be mounted to different locations thereon the arm rest to accommodate arms of various sizes.

In another aspect, the motor can be a fixed speed or variable speed motor comprising an on/off switch and capable of being powered by a conventional power source, such as, for example and without limitation, 120V AC and/or battery power.

The drive mechanism can comprise a means for moving the slidable arm holder back and forth along a substantially linear path. In one embodiment, the drive mechanism can comprise a piston located within a slotted guide cylinder, wherein the piston has a holding pin attached thereto and extending therethrough the slot of the cylinder. In another embodiment, the drive mechanism can comprise a drive plate, a belt configured for turning the drive plate, and a plurality of rotating plates or cams, wherein a holding pin attached to one of the rotating plates or cams is confined to travel linearly back and forth.

In one aspect, the arm holder can be attached to the holding pin such that the drive mechanism can move the arm holder linearly back and forth. A user can then place his arm in the arm holder so that the shoulder CPM device moves his arm, thereby providing therapeutic treatment to the user.

In other aspects, the shoulder CPM device can be used as a stand-alone device, or can be housed in a triangular-type pillow or in a wrap-around pillow. The shoulder CPM device can be relatively lightweight and relatively small, so that it can be portable, allowing a user of the shoulder CPM device to receive treatment in any location, such as, for example, his home or office, instead of having to travel to a hospital or other physical therapy treatment center. Additionally, the shoulder CPM device can be used at night while the user is sleeping. In another aspect, the shoulder CPM device can further comprise a removable covering.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a frame member" can include two or more such frame members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 1:
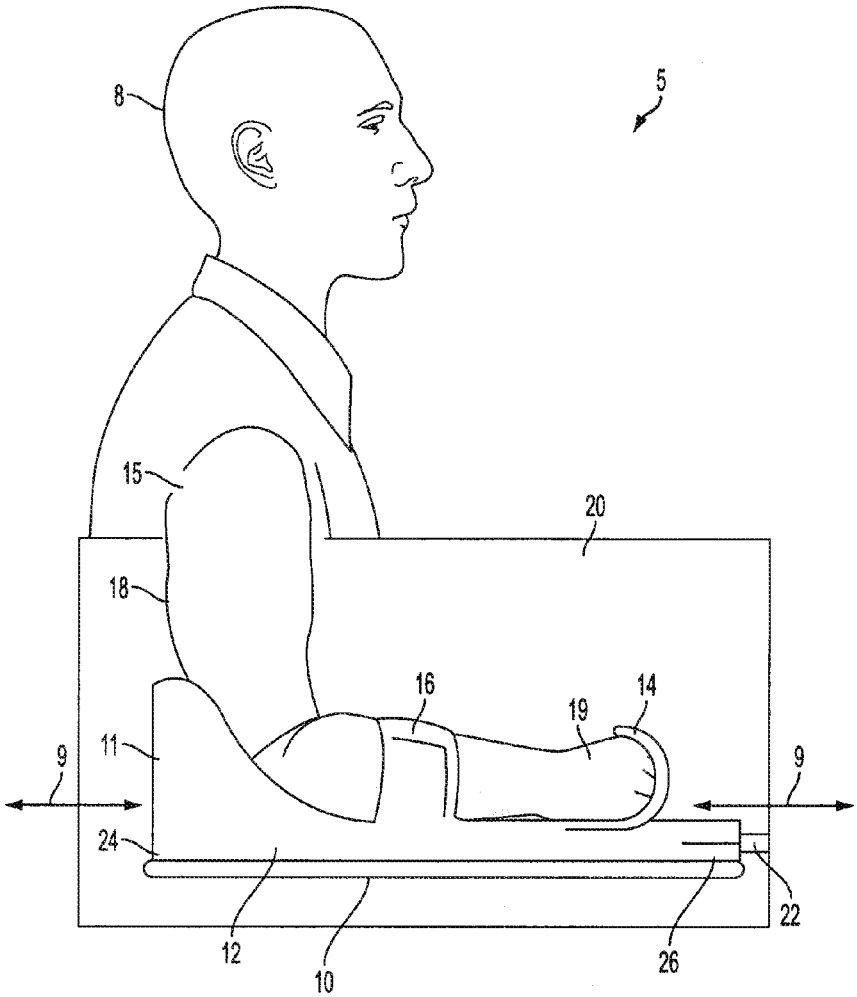
FIG. 1 is side view of a shoulder continuous passive motion device and a user, according to one aspect.

A shoulder continuous passive motion device 5 is provided, according to various aspects. In one aspect, as illustrated in FIGS. 1 and 2, the shoulder CPM device can exemplarily comprise at least one of a slidable arm holder 10, a base plate 20, a support frame 30, a motor 40, and a drive mechanism 50.

Figure 2:
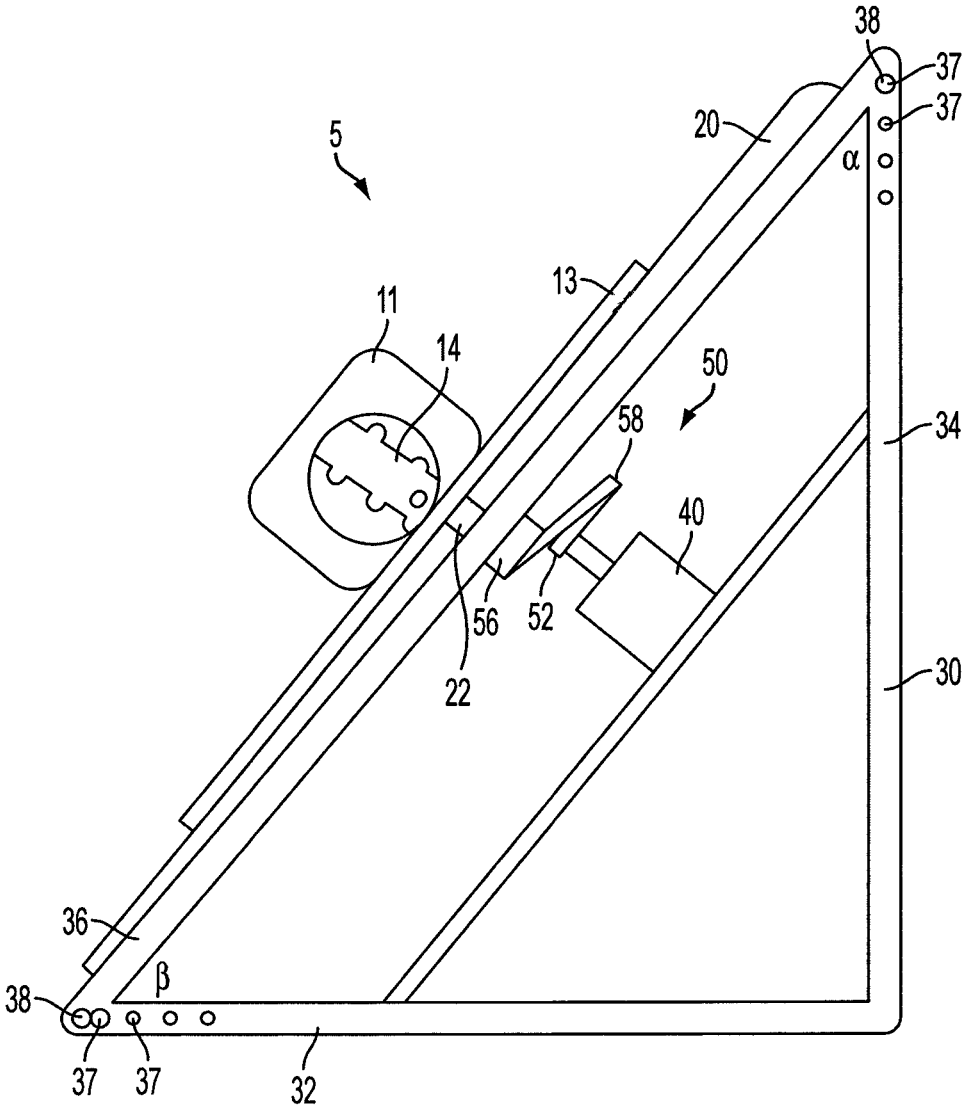
FIG. 2 is an end view of the shoulder continuous passive motion device of FIG. 1, showing a slidable arm holder, a base plate, a support frame, a motor, and a drive mechanism, according to one aspect.

As illustrated in FIG. 2, the support frame 30, in one aspect, can comprise at least one frame member 31 that is substantially triangular in cross-sectional shape. It is contemplated, however, that the at least one frame member can have other cross-sectional shapes, such as substantially square, substantially rectangular, and the like. In another aspect, the at least one frame member can house or otherwise support one or more of the other components of the shoulder CPM device 5. The support frame can be formed from metallic components, such as, for example and not meant to be limiting, aluminum or stainless steel. Alternatively, the support frame can be formed from polymeric components, such as, for example and not meant to be limiting, polypropylene or nylon.

The at least one frame member 31 can be comprised of at least one base member 32, at least one upright member 34, and at least one supporting member 36. In one aspect, the supporting member can be a diagonal supporting member. In another aspect, and not meant to be limiting, the upright member can be between approximately 5 and 20 inches in length, and the base member can be between approximately 5 and 20 inches in length. In still another aspect, the base member can be securedly attached to at least a portion of the upright member 34 at approximately a ninety degree angle. In another aspect, the supporting member can be secured to at least a portion of the upright member, and to at least a portion of the base member. The securing fashion can be permanent, or, optionally, the supporting member can be releasably secured to at least a portion of the base member and/or the upright member. As an example, and not meant to be limiting, the frame members can have a plurality of bores 37 defined therethrough and a pin 38 sized and shaped for insertion into a bore of each member when the respective bores are concentric. In other examples, the securing fashion can comprise any common securing means, such as clasps, clamps, bolts and nuts, pins, rivets, screws, and the like.

In another aspect, an angle $\alpha$ between the upright member 34 and the supporting member 36 can be fixed at approximately 30 degrees and an angle $\beta$ between the base member 32 and the supporting member can be fixed at approximately 60 degrees. In yet another aspect, the angles $\alpha$ and $\beta$ can both be fixed at approximately 45 degrees. In still another aspect, it is contemplated that the angle $\alpha$ can be fixed at any angle between approximately 10 and 80 degrees. In a further aspect, the angles $\alpha$ and $\beta$ can be adjustable. In this aspect, the supporting member can be releasably attached to the upright member 34 and/or the base member 32, with conventional releasable fasteners, such as, for example and not meant to be limiting, screws, bolts, pins, and the like.

In another aspect, a first end of the supporting member 36 can be rotatably attached to the base member with, for example, a hinge, so that the supporting member can rotate with regards to the base member 32. The upright member can then be releasably attached to the supporting member as described above. Optionally, in another aspect, a first end of the supporting member 36 can be rotatably attached to the upright member 34, so that the supporting member can rotate with regards to the upright member. The base member can then be releasably attached to the supporting member as described above.

The base plate 20 is illustrated, in one aspect, in FIGS. 1 and 2. In one aspect, the base plate can be a substantially flat plate that can be securedly attached to an upper surface of the supporting member 36 of the support frame 30. In another aspect, the base plate can be substantially rectangular in shape having two pairs of opposed outer edges. It is of course contemplated, however, that the base plate can be other shapes such as substantially square, substantially circular, and the like.

In one aspect, the base plate can be a covering to separate the slidable arm holder 10 from the drive mechanism 50 to reduce the chance of injury to a user. The base plate 20 can be secured to the support frame by common means, such as, without limitation, clasps, clamps, bolts and nuts, pins, rivets, screws, and the like. In another aspect, if more than one supporting member 36 is present, the supporting members can be spaced throughout the length of the base plate. The base plate 20 can be formed from polymeric materials, metallic materials, wooden materials, or a combination thereof and the like. In yet another aspect, the base plate can define a slot 22 formed therein that has an axis. In this aspect, the slot can be configured to allow a holding pin 60 be positioned therein the slot and to engage or otherwise be coupled to the slidable arm holder 10, as will be described more fully below.

In one aspect, the slidable arm holder 10 can comprise an arm rest 12. The arm rest can be configured to cradle at least a portion of an arm 18 of a user 8, as illustrated in FIG. 1. In another aspect, the arm rest can comprise an elbow pad 11, a hand grip 14 and at least one strap 16. The elbow pad can be formed of a soft material, such as foam, and can be configured to receive an elbow 17 of a user therein. In one aspect, the elbow pad can be adjustably, releasably mounted on a first end 24 of the arm rest 12 by conventional means, such as screws, bolts, pins, hook and loop fasteners, and the like. In another aspect, the hand grip can be configured to be grasped by a hand 19 of the user 8 and can be adjustably, releasably mounted on a second end 26 of the arm rest 12 by conventional means, such as screws, bolts, pins, hook and loop fasteners, and the like. In yet another aspect, the first end and/or the second end can have a variety of mounting locations so that the shoulder CPM device 5 can be used with different sized arms (e.g., an adult arm or a child arm). The at least one strap 16 can be formed from, for example and not meant to be limiting, hook and look fasteners, and can be configured for securing an arm 18 of the user 8 to the arm rest 12. In yet another aspect, the elbow pad 11 and the hand grip can be interchangeably mounted, such that the elbow pad can be adjustably, releasably mounted on the second end of the arm rest, and the hand grip 14 can be adjustably, releasably mounted on the first end of the arm rest 12. Thus, it is contemplated that the elbow pad and the hand grip can be mounted on either the first end 24 or the second end 26 of the arm rest, and the shoulder CPM device 5 can be used on the left arm of a user, or the right arm of a user, as will be described more fully below.

In another aspect, the slidable arm holder 10 can further comprise an arm plate 13. The arm plate can be a substantially flat plate formed from polymeric materials, metallic materials, wooden materials, or a combination thereof and the like. In one aspect, the arm plate 13 can have an area smaller than the base plate 20, such that when the arm plate slides on the outer surface of the base plate, as will be described below, outer edges of the arm plate do not extend beyond the outer edges of the base plate.

In yet another aspect, the arm rest 12 can be fixably attached to the arm plate 13 by conventional means, such as adhesives, hook and loop fasteners, clasps, clamps, bolts and nuts, pins, rivets, screws, and the like. In still another aspect, the arm rest and/or the arm plate can have means for attachment to the holding pin 60. In one aspect, the means for attachment can comprise a pressure fit between the holding pin and a complementary aperture 28 therein the arm rest 12 and/or the arm plate 13. In another aspect, the means for attachment can comprise a threaded holding pin and a complementarily threaded nut securedly attached to the arm rest and/or the arm plate. The arm holder 10 can be slidably mounted thereon the outer surface of the base plate, so that the drive mechanism can slide the arm holder back and forth as indicated by arrow 9 of FIG. 1.

The motor 40, in one aspect, can be a conventional commercially available motor, as commonly known in the arts, configured for producing rotational motion. In one aspect, the motor can comprise a rotational motion output, such as, for example and without limitation, a motor shaft. In another aspect, the motor can comprise an on/off switch. The motor can be a fixed speed or a variable speed motor. In one aspect, if the motor is a variable speed motor, the motor 40 can further comprise a means for adjusting the speed of the motor. In another aspect, the motor can be powered by a conventional power source, such as, for example and without limitation, a 120V AC supply and/or a battery for portable use. In yet another aspect, the motor 40 can be a variable speed motor so that a user 8 of the device can adjust the speed of the drive mechanism as desired.

The drive mechanism 50 can comprise means for moving the slidable arm holder 10 back and forth along a substantially linear pathway, according to one aspect. In another aspect, it is contemplated that the drive mechanism can comprise means for moving the slidable arm holder back and forth along a substantially non-linear pathway. In a further aspect aspect, it is contemplated that the drive mechanism can comprise means for moving the slidable arm holder back and forth along a predetermined pathway, which can optionally comprise at least a portion that is linear and at least a portion that is non-linear.

Figure 3:
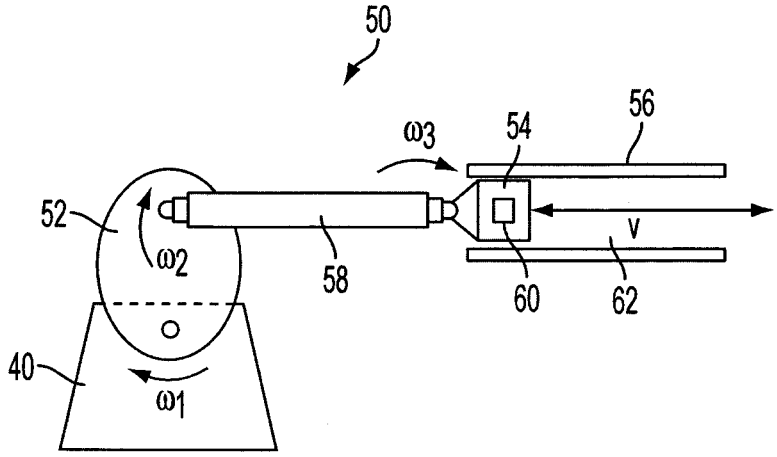
FIG. 3 is a schematic view of one embodiment of the drive mechanism of FIG. 2.

In one embodiment, as illustrated in FIG. 3, the drive mechanism 50 can exemplarily comprise at least one of: a cam 52 or crankshaft, a piston 54, a slotted guide cylinder 56, and a connecting rod 58, as are commonly known in the arts. The connecting rod being coupled to the holding pin 60. In one aspect, the slotted guide cylinder can have a slot 62 located therein a wall of the slotted guide cylinder configured to allow the holding pin to slidably protrude from the cylinder. In one aspect, the cam or crankshaft, the connecting rod, and/or the piston can be sized so that the shoulder CPM device runs at an appropriate speed and can fit under the base plate 20 when installed, as will be described below. Additionally, the cam 52 can be sized such that the stroke distance of the piston is an appropriate length to induce the range of motion necessary for rehabilitation of a shoulder. In another aspect, the stroke distance of the piston 54 can be varied by, for example and without limitation, attaching the connecting rod 58 to the cam at a different location on the cam 5, so that the range of motion through which an arm holder, and thus the arm of the patient, is moved can be adjusted.

In another embodiment, the drive mechanism 50 can exemplarily comprise at least one of a drive plate, a belt configured for turning the drive plate, and a plurality of rotating plates or cams, wherein the holding pin attached to one of the rotating plates or cams is confined to travel back and forth throughout a desired pathway. As can be appreciated, there are other conventional mechanisms by which rotational energy from the motor 40 can be converted to linear energy and transmitted to the arm holder 10.

With reference to FIGS. 1 and 2, a shoulder continuous passive motion device 5 can be assembled to comprise any or all of the components as described above. In one embodiment, the support frame 30 can be assembled from at least one frame member 31, as described above. In another aspect, the support frame can be assembled such that the angle $\alpha$ between the upright member 34 and the supporting member 36 and the angle $\beta$ between the base member 32 and the supporting member are at predetermined angles. If the angles $\alpha$ and $\beta$ are adjustable, the supporting member can be releasably attached to the upright member 34 and/or the base member 32, with conventional releasable fasteners, so that a user of the device can make adjustments to the angles as desired.

The base plate 20 can be securedly attached to the upper surface of the supporting member 36 of the support frame. The slotted guide cylinder 56 can be securedly attached to a bottom side of the base plate 20 such that the slot 62 located therein the cylinder is aligned with the slot 22 of the base plate. The motor 40 can be securedly attached to the support frame 30 at a location such that when in operation, the piston can slidingly engage the slotted guide cylinder throughout the desired stroke. The cam can be securedly attached to a shaft of the motor, and the connecting rod 58 can be rotatably attached to the cam 52. The piston can be rotatably attached to the connecting rod and can be located therein the cylinder. The holding pin 60 can be securedly attached to the piston 54 and can protrude therethrough the slot 62 in the cylinder and the slot 22 in the base plate.

The elbow pad 11 can be securedly attached to either the first end 24 or the second end 26 of the arm rest 12 as desired, for left or right hand use. The hand grip 14 can be securedly attached to the opposed end of the arm rest, and the at least one strap 16 can be securedly attached to the arm rest at a point between the first end and the second end. The arm rest 12 can be securedly attached to the arm plate 13, if present, as described above. The arm holder 10 can then be securedly attached to the holding pin 60. As described above, the arm holder can be secured to the holding pin by, for example, a pressure fit between the holding pin and a complementary aperture 28 therein the arm rest 12 and/or the arm plate 13. Thus, the arm holder 10 can be slidably mounted thereon the base plate, so that the drive mechanism can slide the arm holder back and forth as indicated by arrow 9 of FIG. 1.

To use the shoulder CPM device 5, a user 8 can connect the motor 40 to a power source such as a battery or electrical outlet through a conventional plug. The user can adjust the elbow pad 11 and hand grip 14 so that the left or right shoulder, as desired, can be treated. In one aspect, the user can also adjust the location of the elbow pad and/or the hand grip to the proper size for the desired arm. In another aspect, the user can adjust the angle of the base plate 20, as described above, by altering the attachment points between the supporting member 36, the upright member 34, and/or the base member 32 of the at least one frame member 31. In still another aspect, the user can adjust the piston stroke by altering the point of connection between the connecting rod 58 of the drive mechanism and the cam 52, thereby adjusting the range through which the arm will be induced to move. The user can then insert the desired arm 18 into the slidable arm holder 10, resting his elbow 17 on the elbow pad 11 and gripping the hand grip 14 with his hand 19. The at least one strap 16 can be fastened around the arm of the user 8, so that the arm is secured therein the arm holder. The motor can be turned on and the speed adjusted to a desired speed if the motor 40 is a variable speed motor. The motor can turn the cam, which causes the piston 54 and holding pin 60 to slide back and forth laterally therein the cylinder. The arm holder, attached to the holding pin, also slides back and forth laterally, moving the arm 18 of the user through the desired range of motion.

Figure 4:
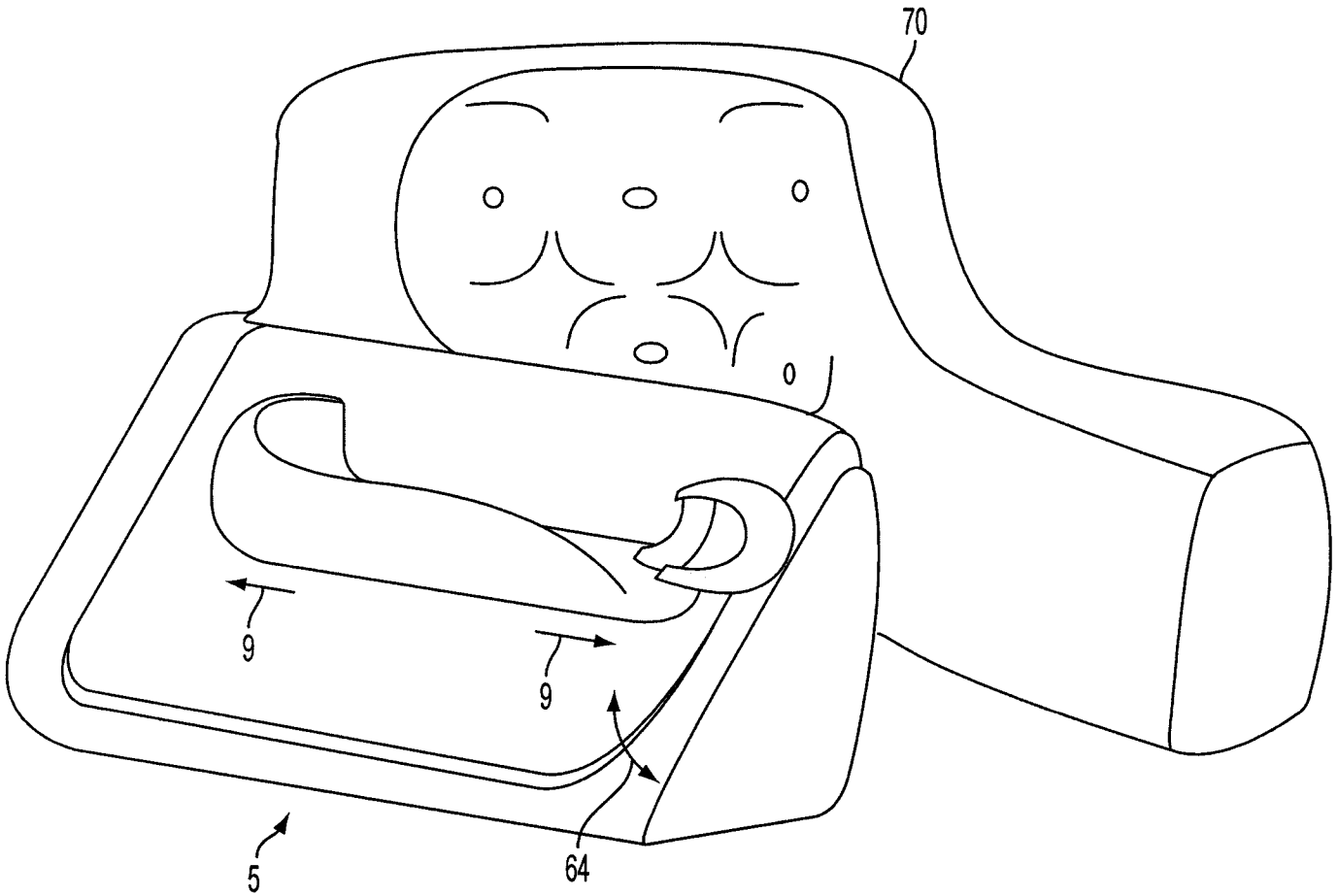
FIG. 4 is a perspective view of a shoulder continuous passive motion device housed in a pillow, according to one aspect.
Figure 5:
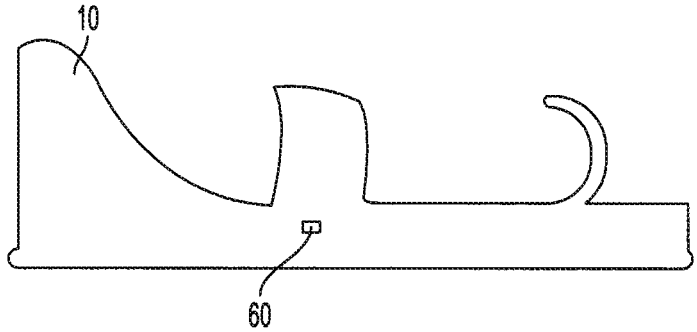
FIG. 5 is an elevational view of a portion of the shoulder continuous passive motion device of FIG. 1.

The assembled shoulder CPM device can be used as a stand-alone device, or in one aspect, the assembled shoulder CPM device can be housed in a triangular-type pillow or in a wrap-around pillow, as illustrated in FIG. 4. The shoulder CPM device 5 can be relatively small and/or relatively lightweight when compared to existing shoulder CPM devices. In one aspect, the shoulder CPM device of this application can be portable, and can be placed in, for example and without limitation, a chair or a bed. This allows a user of the shoulder CPM device 5 to receive treatment in any location instead of having to travel to a hospital or other physical therapy treatment center. Thus, in another aspect, the shoulder CPM device 5 can be used in a convenient location, such as, for example, a home or office. Additionally, the shoulder CPM device of this application can be used at night while the user is sleeping. In another aspect, the shoulder CPM device 5 can further comprise a removable covering 70. The removable covering can be formed from, for example and not meant to be limiting, plastic or fabric materials. The removable covering can be configured to cover the shoulder CPM device and/or any pillows that can house the device. In another aspect, the removable covering can be washable after removal from the shoulder CPM device.

In another embodiment, the shoulder CPM device 5 can further comprise a means for providing multiple degrees of motion, comprising for example, simple back and forth motion (anterior/posterior), as described above, and abduction/adduction motion. In this embodiment, the drive mechanism 50 can further comprise a means for moving the slidable arm holder back and forth as well as up and down. In one aspect, the drive mechanism 50 can comprise at least one of: a cam 52 or crankshaft, a piston 54, a slotted guide cylinder 56, a connecting rod 58, and a holding pin 60, all as described above, and at least one offset gear or cam. The at least one offset gear or cam can be attached to motor 40 or to a second motor. In another aspect, the at least one offset gear or cam can interact with the base plate to cause the base plate to move up and down, as indicated by arrow 64 in FIG. 4, which induces abduction/adduction movement to the shoulder 15 of a user 8 of the device.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A shoulder continuous passive motion device comprising:

a motor configured for producing rotational motion;

a base plate defining a slot therein, the slot having an axis;

a holding pin positioned therein the slot;

means for converting rotational motion from an output of the motor to substantially linear motion of the holding pin therealong the axis of the slot;

an arm holder configured to hold at least a portion of an arm of a user, wherein the arm holder is coupled to the holding pin.

2. The shoulder continuous passive motion device of claim 1, wherein the motor is a variable speed motor, and wherein the speed of the motor is adjustable.

3. The shoulder continuous passive motion device of claim 1, wherein the device comprises at least one frame member configured to support at least a portion of the base plate.

4. The shoulder continuous passive motion device of claim 3, wherein the at least one frame member comprises at least one base member, at least one upright member, and at least one supporting member.

5. The shoulder continuous passive motion device of claim 4, wherein an angle between the at least one upright member and the at least one supporting member is fixed at a predetermined angle.

6. The shoulder continuous passive motion device of claim 4, wherein an angle between the at least one upright member and the at least one supporting member is adjustable.

7. The shoulder continuous passive motion device of claim 1, wherein the arm holder comprises an arm rest.

8. The shoulder continuous passive motion device of claim 7, wherein the arm rest comprises an elbow pad and at least one strap.

9. The shoulder continuous passive motion device of claim 8, wherein the elbow pad is releasably attached to the arm rest.

10. The shoulder continuous passive motion device of claim 8, wherein the elbow pad is adjustably attached to the arm rest.

11. The shoulder continuous passive motion device of claim 8, wherein the at least one strap is releasably attached to the arm rest.

12. The shoulder continuous passive motion device of claim 8, wherein the at least one strap is adjustably attached to the arm rest.

13. The shoulder continuous passive motion device of claim 7, wherein the arm holder further comprises an arm plate configured to slide thereon a portion of an outer surface of the base plate.

14. The shoulder continuous passive motion device of claim 1, further comprising a removable covering configured to cover at least a portion of the device.

15. The shoulder continuous passive motion device of claim 1, wherein the means for converting rotational from the motor to a substantially linear motion of the holding pin comprises a drive mechanism having a stroke distance.

16. The shoulder continuous passive motion device of claim 15, wherein the stroke distance of the drive mechanism is adjustable.

17. The shoulder continuous passive motion device of claim 1, wherein the device further comprises a pillow, and wherein at least a portion of the means for converting rotational motion from the motor to a substantially linear motion of the holding pin therein the slot is housed therein the pillow.

18. A shoulder continuous passive motion device comprising:

a motor configured for producing rotational motion;

a base plate defining a slot therein, the slot having an axis;

a holding pin positioned therein the slot, wherein the holding pin is configured to translate axially therealong the slot of the base plate;

a drive mechanism coupled to the motor, wherein the drive mechanism is configured to convert rotational motion from an output of the motor to substantially linear motion of the holding pin therealong the slot of the base plate; and an arm holder coupled to the holding pin and configured to hold at least a portion of an arm of a user.

19. A method for rehabilitating a shoulder joint injury of a patient, comprising:

providing a shoulder continuous passive motion device comprising:

a motor configured for producing rotational motion;

a base plate defining a slot therein;

a holding pin positioned therein the slot, wherein the holding pin is configured to translate axially therealong the slot of the base plate a drive mechanism coupled to the motor, wherein the drive mechanism is configured to convert rotational motion from an output of the motor to substantially linear motion of the holding pin therealong the slot of the base plate; and an arm holder coupled to the holding pin;

inserting at least a portion of an arm of the patient therein the arm holder; and actuating the motor to effect a desired axial movement of the arm holder.

* * * * *